US009649637B2

(12) United States Patent
Muller et al.

(10) Patent No.: US 9,649,637 B2
(45) Date of Patent: May 16, 2017

(54) DEVICE AND METHOD FOR PROCESSING MATERIALS

(71) Applicant: HAVER & BOECKER OHG, Oelde (DE)

(72) Inventors: Hagen Muller, Brand Erbisdorf ot Langenau (DE); Bernd Wauligmann, Munster (DE)

(73) Assignee: HAVER & BOECKER OHG, Oelde (DE)

( * ) Notice: Subject to any disclaimer, the term of this patent is extended or adjusted under 35 U.S.C. 154(b) by 365 days.

(21) Appl. No.: 14/361,081

(22) PCT Filed: Nov. 28, 2012

(86) PCT No.: PCT/EP2012/004898

§ 371 (c)(1),
(2) Date: May 28, 2014

(87) PCT Pub. No.: WO2013/079189

PCT Pub. Date: Jun. 6, 2013

(65) Prior Publication Data

US 2014/0332610 A1 Nov. 13, 2014

(30) Foreign Application Priority Data

Nov. 29, 2011 (DE) ..... 10 2011 119 621

(51) Int. Cl.

| | |
|---|---|
| ***B02C 17/22*** | (2006.01) |
| ***B02C 17/00*** | (2006.01) |
| ***B07B 13/00*** | (2006.01) |
| ***B02C 17/24*** | (2006.01) |
| ***B02C 23/08*** | (2006.01) |
| ***B02C 23/02*** | (2006.01) |

(52) U.S. Cl.

CPC ..... *B02C 17/002* (2013.01); *B02C 17/22* (2013.01); *B02C 17/24* (2013.01); *B02C 23/02* (2013.01); *B02C 23/08* (2013.01); *B07B 13/003* (2013.01)

(58) Field of Classification Search

USPC ..... 241/172, 176, 182, 183

See application file for complete search history.

(56) References Cited

U.S. PATENT DOCUMENTS 3,056,561 A * 10/1962 Hukki ..... B02C 17/002 241/172
3,329,350 A * 7/1967 Wisgerhof ..... B02C 13/18 241/187

(Continued)

FOREIGN PATENT DOCUMENTS

DE 1166111 11/1962
DE 1758512 1/1971

(Continued)

*Primary Examiner* — Mark Rosenbaum

(74) *Attorney, Agent, or Firm* — Pearne & Gordon LLP

(57) ABSTRACT

Apparatus and method for processing materials such as granular matter mined from deposits, comprising a tubular container disposed upright and an axle device provided centered therein. A processing chamber for receiving the material to be processed is provided between the axle device and the inner wall of the tubular container. The tubular container is driven rotatingly. Engaging dogs are provided in the processing chamber as working elements.

28 Claims, 5 Drawing Sheets

(56) References Cited

U.S. PATENT DOCUMENTS

Figure 1:
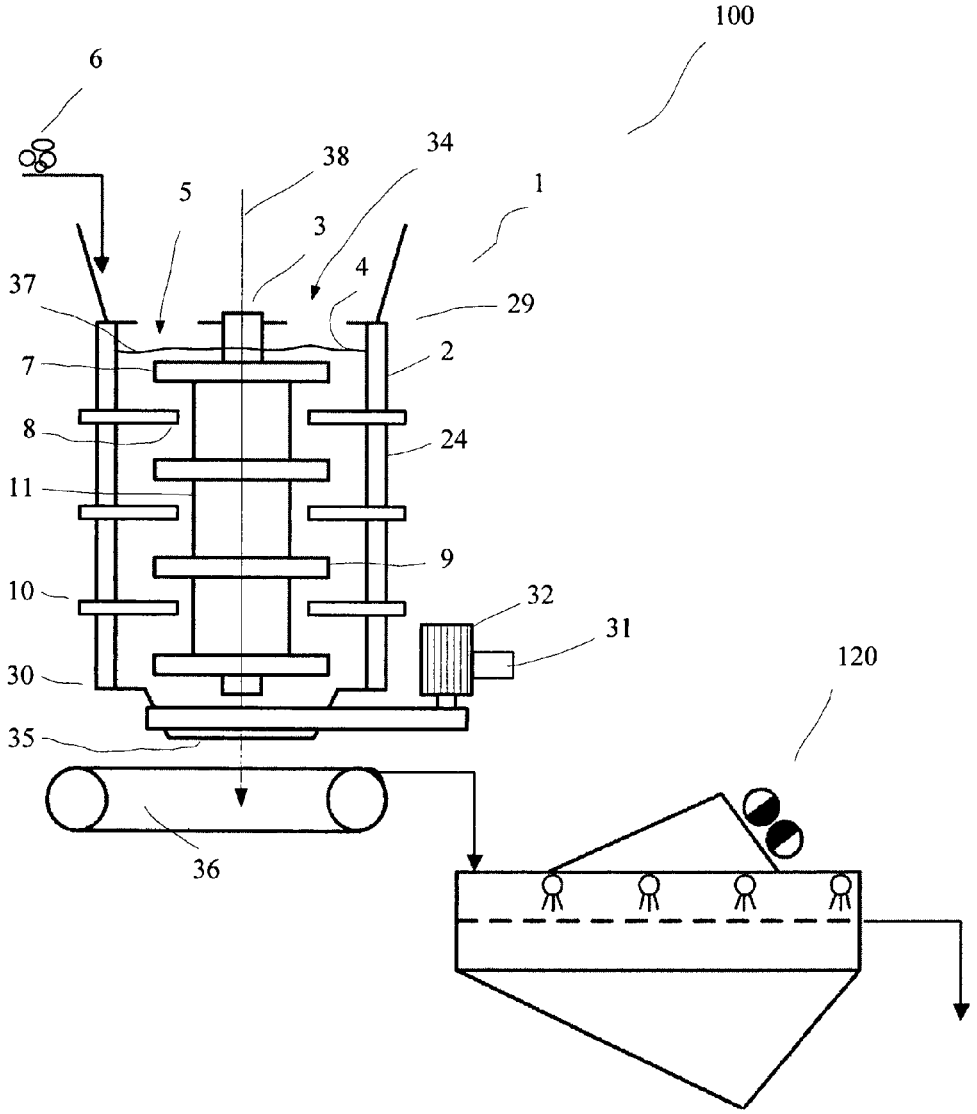

| | | | | | |
|---|---|---|---|---|---|
| 3,797,761 | A * | 3/1974 | Neil | B29B 17/0005 | 241/101.8 |
| 3,845,905 | A | 11/1974 | Haslberger | | |
| 4,776,522 | A * | 10/1988 | Hoffmann | B02C 17/166 | 241/176 |
| 5,346,146 | A * | 9/1994 | Nitta | B02C 17/163 | 241/172 |
| 2003/0209618 | A1 * | 11/2003 | Sneeringer | B01F 7/00466 | 241/172 |

FOREIGN PATENT DOCUMENTS

| | | |
|---|---|---|
| DE | 2212251 | 9/1973 |
| DE | 2812985 | 10/1978 |
| DE | 4419919 C1 * | 2/1995 |

* cited by examiner

DEVICE AND METHOD FOR PROCESSING MATERIALS

The present invention relates to an apparatus and a method for processing materials. The invention in particular relates to a cleaning device and a method for processing materials containing granular matter mined from deposits and/or a cleaning device and a method for crushing lumpy foreign matter contained in raw gravel such as clay or the like. Use in the area of recycling for example slag, construction materials is also conceivable.

Various cleaning devices for processing materials have been disclosed in the prior art.

DE 2 812 985 A1 discloses an apparatus for treating crushed rocks which is equipped with a horizontal, hollow rotary drum and a rotor installed off-center therein. The rotary drum is disposed inclined slightly horizontally. The rotational drives for the rotary drum and for the rotor rotate in opposite directions. The off-center rotor position relative to the rotary drum provides in one place a narrowed gap for mechanically treating the crushed rock. The horizontal placement of the rotary drum causes the apparatus in DE 2 812 985 A1 to require considerable space since it can only attain a low filling capacity.

DE 2 212 251 C3 discloses an apparatus for crushing lumpy foreign matter contained in raw gravel such as clay or the like where a stationary, tubular container mounted in the vertical is provided in which an agitator is disposed on a rotatable axle for stirring the material to be processed in the vertical container. The apparatus according to DE 2 212 251 C3 requires less space although its throughput is likewise limited. The energy input shows very little intensity due to the agitator's geometry since only a small portion of particles makes direct contact with the agitator.

It is therefore the object of the present invention to provide an apparatus and a method for processing materials enabling high throughput while requiring little space.

This object is solved by a cleaning device having the features of claim 1 and by a method having the features of claim 25. Preferred specific embodiments of the invention are defined in the subclaims. Further advantages and features can be taken from the general description and the description of the exemplary embodiment.

A cleaning device according to the invention serves for processing materials. The cleaning device in particular serves for processing materials which comprise granular matter mined from deposits. The cleaning device for processing materials may also be provided for crushing lumpy foreign matter contained in raw gravel such as clay or the like. The cleaning device according to the invention comprises a tubular container disposed upright. An axle device is substantially centered in the tubular container. A processing chamber for receiving the material to be processed is provided between the axle device and the inner wall of the tubular container. The tubular container can be driven rotatingly. Engaging dogs are provided in the processing chamber as working elements.

The cleaning device according to the invention has many advantages. It is a considerable advantage of the inventive cleaning device that the container if placed upright can be driven rotatingly. The axle device may be provided stationary. The rotational movement of the tubular container causes the relative motion between the engaging dogs in the processing chamber and the processing chamber or the tubular container or the axle device, respectively.

Surprisingly it has been found that unlike a rotating center axis, a driven, rotating outer wall shows a considerably enhanced capturing effect on the material contained therein and in this way an increased quality of the milling through and the cleaning effect can be achieved. Preferably at least one working element is provided on the tubular container.

In a preferred specific embodiment at least one working element is exchangeably disposed on the tubular container. This specific embodiment is very advantageous since it allows simpler maintenance and simpler settings of various properties in the processing of materials. Exchanging a working element for example because of wear allows to readily continue operation. Exchanging the external working element does not require emptying the processing chamber of the material contained.

Preferably at least one working element is exchangeably disposed on the axle device. A configuration where working elements are disposed both on the tubular container and on the axle device allows particularly effective processing and cleaning of the processed materials. This applies in particular in the case where the working elements or at least two working elements overlap in the processing direction and/or in the vertical direction. This is understood to mean that in operation at least two working elements overlap at least temporarily in the vertical direction. In other words, the operating ranges of at least two working elements overlap at least partially in the vertical direction.

An adjustable or variable working gap is preferably provided between the inner wall of the tubular container and an outer wall of the axle device. An adjustable working gap offers the option of influencing the working speed of the cleaning device. A larger working gap increases the throughput while a smaller working gap reduces the throughput although the intensity is increased. A working gap can thus be adapted to be ideal for the material to be processed.

The working gap can in particular be provided adjustable in increments or continuously over the height of the tubular container. This allows multiple different working gaps over the height of the tubular container. In this way the residence time may be increased in a first vertical section.

The axle device preferably comprises an axle configured non-round surrounded by spacers configured substantially round. The non-round axle may be configured polygonal or it may have a star-shaped, egg-shaped, oval, Torx-shaped or similar cross section.

Spacers are preferably provided in different diameters so as to provide different working gaps. Spacers having defined—identical or different—lengths may be lined up on the axle. Lining up spacers having different diameters creates different working gaps over the height. The number of working elements can be varied by way of the number of identical or different spacers.

At least one working element is preferably configured as an inner working element protruding into the processing chamber from inside. This inner working element may in particular be configured to be clipped on the axle. The inner working element can preferably be oriented at different angles to the axle.

The inner working element or the working element disposed in the interior may comprise one, two, three, four, or more engaging dogs. In the case of multiple engaging dogs these are in particular disposed substantially symmetrically over the circumference of the working element. For example a working element having three engaging dogs shows the engaging dogs disposed at angles of 120° relative to one another after mounting on the axle.

Preferably the axle is provided with at least one working element disposed in the interior between at least two spacers. Or else two or more spacers may be immediately adjacent to one another. Or else, instead of a working element a unit of similar configuration may be provided which has no engaging dogs and does not act on the processing chamber. Then such a unit may optionally be placed between two spacers instead of a working element. In the simplest of cases such a unit is a circular disk which is clipped onto the axle.

Preferably at least one working element is configured as an exterior working element or a working element disposed on the outside which protrudes into the processing chamber from outside. The outer working element is in particular inserted into the processing chamber from outside through the wall of the tubular container. This configuration is particularly advantageous because it provides great ease of exchanging outer working elements. A working element may be removed outwardly through the wall of the tubular container, and a similar or a different working element may be inserted into the processing chamber from outside through the wall.

The insertion opening for inserting a working element may for example be closed by a suitable closing head if no working element is needed in the insertion opening.

In this way a plurality of insertion openings may be provided on the outer periphery of the tubular container, a smaller or larger number of which is used—as needed—to receive working elements.

This allows a particularly flexible construction in which the number and type of the acting working elements can be adjusted as required.

Accordingly, different working elements having engaging dogs of different lengths and/or shapes may be provided. Both internally disposed working elements and externally disposed working elements may be provided having engaging dogs of different lengths and/or shapes.

Any external or externally disposed working elements are preferably secured by at least one stud member. Such securing can prevent unintentional pulling or pushing out and may optionally serve as a torque multiplier in operation.

It is also possible to equip some, multiple, or all of the working elements with engaging dogs where different angles to the longitudinal axis of the engaging dog ensue. An engaging dog may for example be configured as an elongated, approximately sword-shaped rod whose sword surface is disposed in a vertical plane or else inclined to the vertical plane. An inclination to one or another direction allows to axially guide the material to be processed toward the exit or toward the entry due to cooperating with the respective engaging dog to reduce or extend the processing period.

In preferred specific embodiments the tubular container comprises a wear protection device on the inner wall. The wear protection device may in particular be configured as an autogenous wear protection and it may, in particular at least in sections, comprise circumferential webs and preferably longitudinal stays extending in transverse.

This type of wear protection device causes material to be processed to accumulate in the pockets forming between the webs and the longitudinal stays which thus reliably protects the wall of the tubular container from abrasion. Then the abrading loads and stresses do not act immediately on the inner surface of the tubular container but abrading loads and stresses occur within the materials to be processed so as to enable effective prolongation of the service time.

The tubular container is preferably supported on the top end and/or the bottom end at least in one region. Or else the tubular container may be supported in regions of the top and bottom ends. The tubular container may be supported exactly at the top end and/or at the bottom end. Or else supporting may be provided spaced apart from the top and bottom ends. Supporting is also possible and preferred only on top and at the bottom and in particular only at the bottom.

Preferably at least one control device is provided for controlling in particular the rotational speed of the tubular container.

For driving the rotatable tubular container at least one motor is in particular provided which drives the tubular container for example by way of a belt drive or a gear transmission. The motor may in particular be a gearless direct drive such as in particular a torque motor. Other drives are likewise conceivable.

At least one fill level sensor may be provided to allow control of the processing in dependence on the fill height in the processing chamber or in the tubular container.

Advantageous specific embodiments provide at least one top filling mouth for feeding material and at least one bottom discharge opening for discharging material. The top filling mouth in particular has a conveyor belt or a filling hopper assigned to it and downstream of the bottom discharge opening preferably at least one discharge element is disposed which is taken from a group of discharge elements including belt conveyors, scraper chain conveyors, rotary vane locks, and vibrating conveyors.

The degree of filling in operation is on average preferably above 0.4, and in particular above 0.6 and preferably above 0.7 and particularly preferably above 0.8. Values of 0.9 and above are likewise conceivable. The degree of filling is preferably sensed by the fill level sensor and controlled by way of the control device.

The axle device may be configured stationary. Or else the axle device may be configured rotary. An axle device that is configured rotary is in particular provided rotating in the opposite sense of the tubular container.

The method according to the invention serves for processing materials such as granular matter mined from deposits and/or for crushing lumpy foreign matter contained in raw gravel such as clay or the like and it is carried out by a cleaning device which comprises a tubular container disposed upright in the cleaning device and an axle device substantially centered in the tubular container. A processing chamber for receiving the material to be processed is spanned between the axle device and the inner wall of the tubular container. The tubular container is driven rotatingly and working elements in the shape of engaging dogs are provided in the processing chamber.

The method according to the invention is also very advantageous since it allows efficient treatment and processing of materials.

In the sense of the present invention a tubular container disposed upright is in particular understood to mean a tubular container that is disposed substantially in the vertical. The tubular container may be aligned precisely vertical. Or else the tubular container and/or its rotation axis may be disposed inclined at a slight angle to the vertical. Angles of 2°, 5°, 10°, 15° or 20° are for example conceivable. The inclination angle is at any rate less than 30° and preferably less than 10°.

Further advantages of the present invention can be taken from the exemplary embodiment which will be described below with reference to the enclosed figures.

Figure 2:
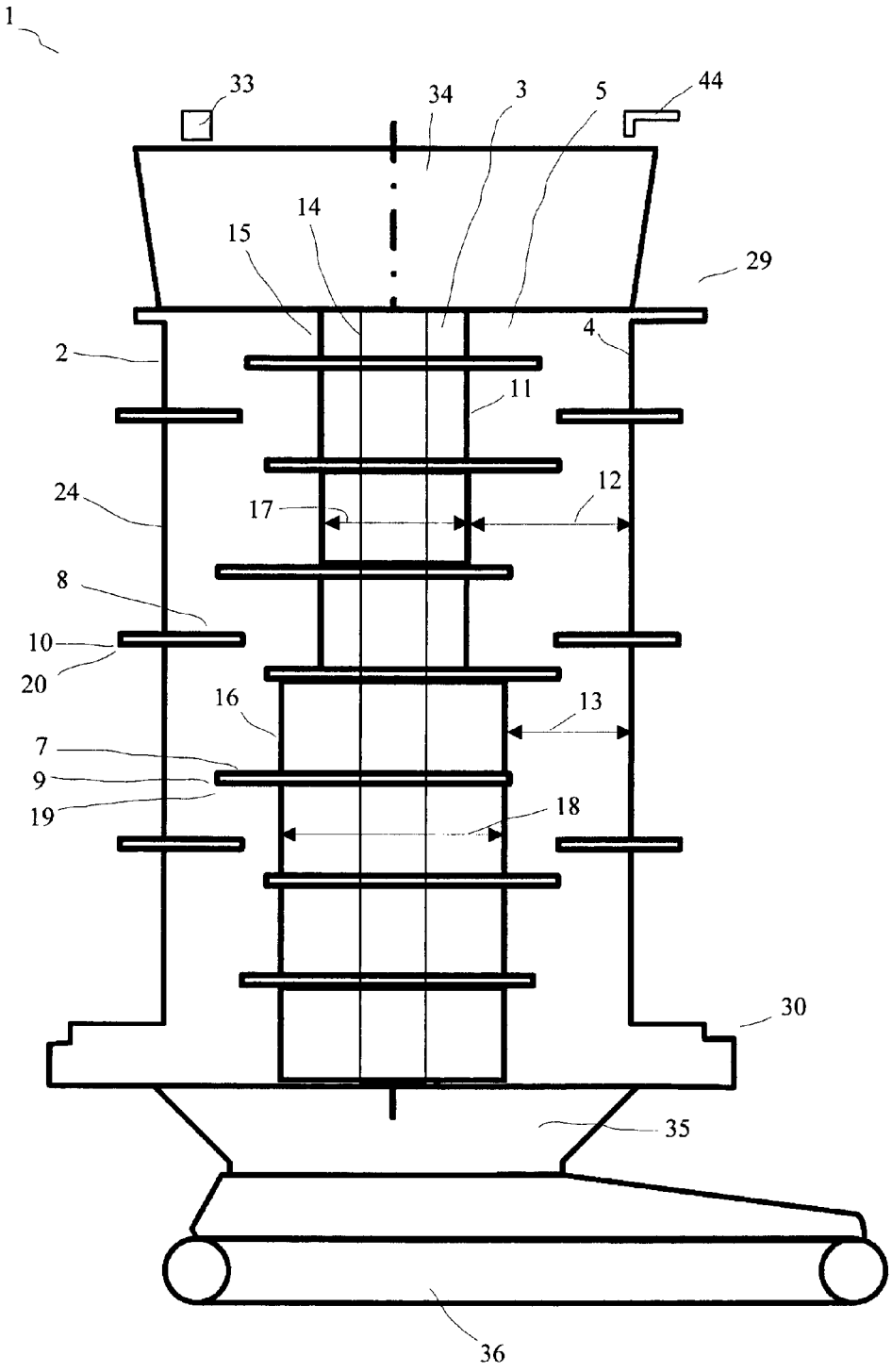
Figure 3:
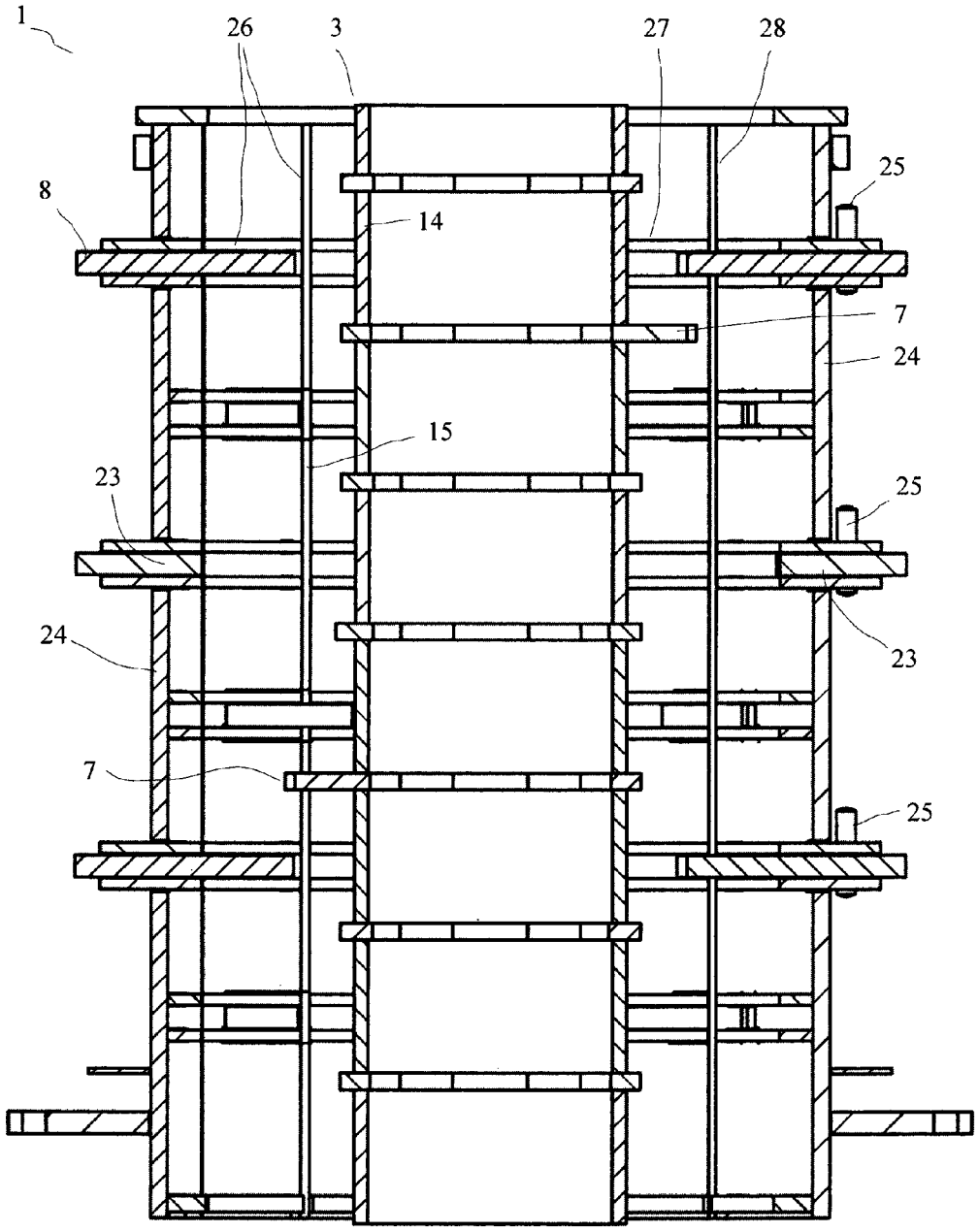
Figure 4:
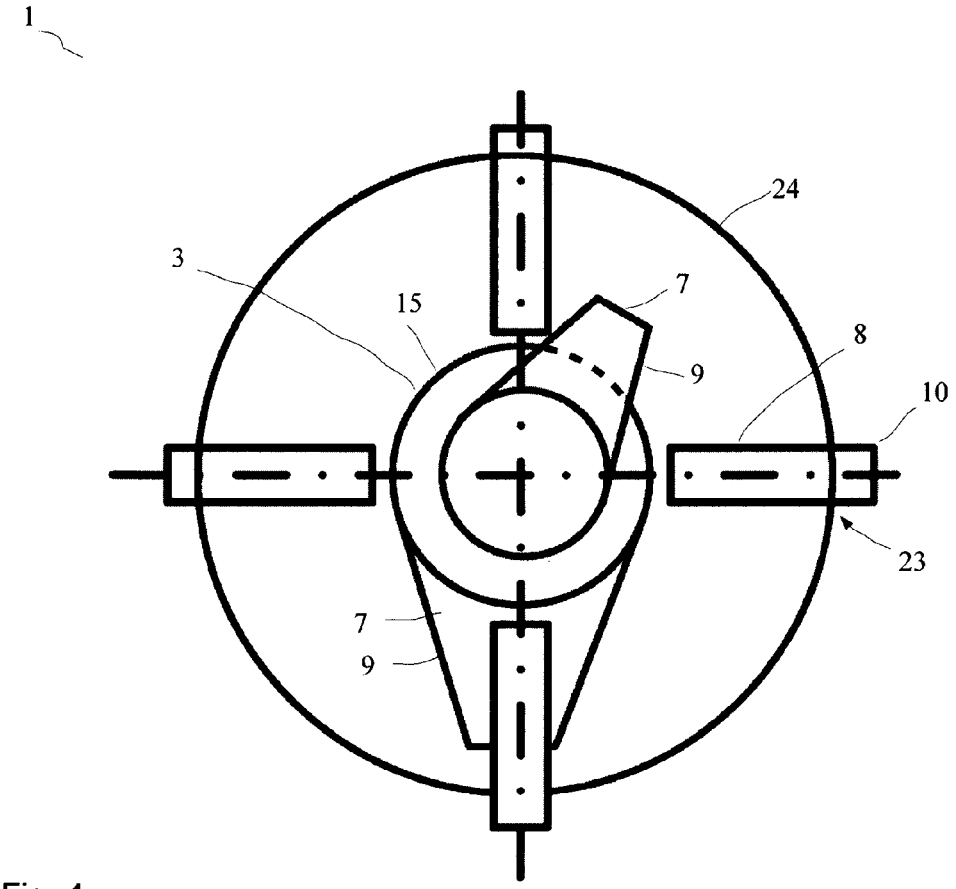
Figure 5:
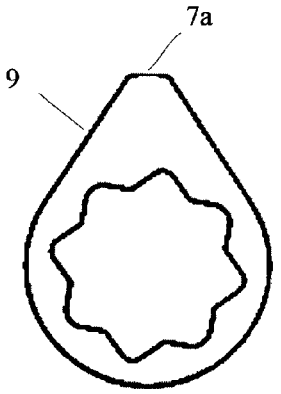
Figure 6:
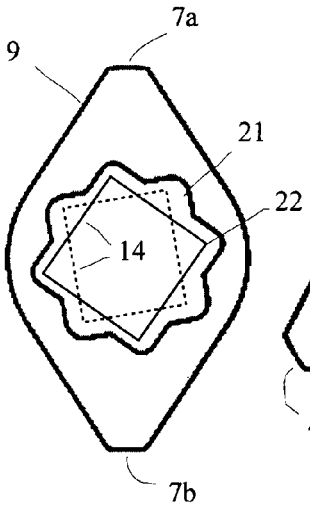
Figure 7:
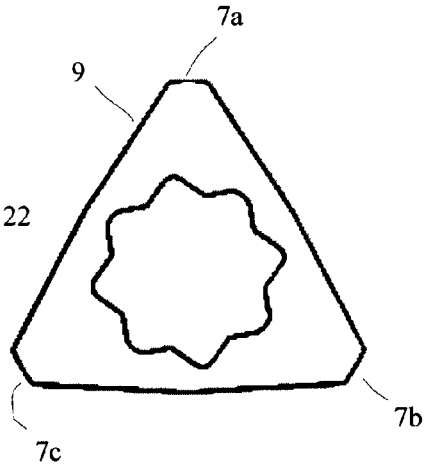
Figure 8:
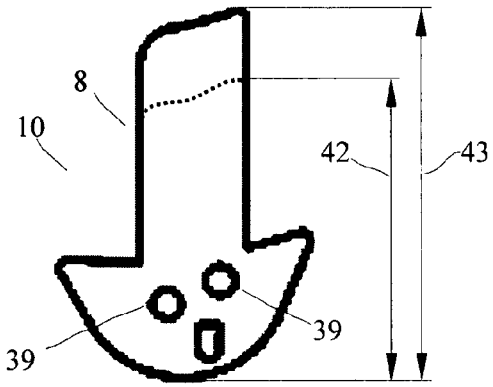
Figure 9:
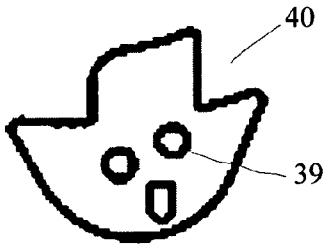

The figures show in:

FIG. 1 a schematic illustration of a processing plant;

FIG. 2 a side view of the cleaning device according to the invention;

FIG. 3 a cross section of the tubular container of the cleaning device according to FIG. 2;

FIG. 4 a schematic top view of the tubular container;

FIG. 5 a first inner working element;

FIG. 6 a second inner working element;

FIG. 7 a third inner working element;

FIG. 8 an outer working element;

FIG. 9 a closing head; and

Figure 10:
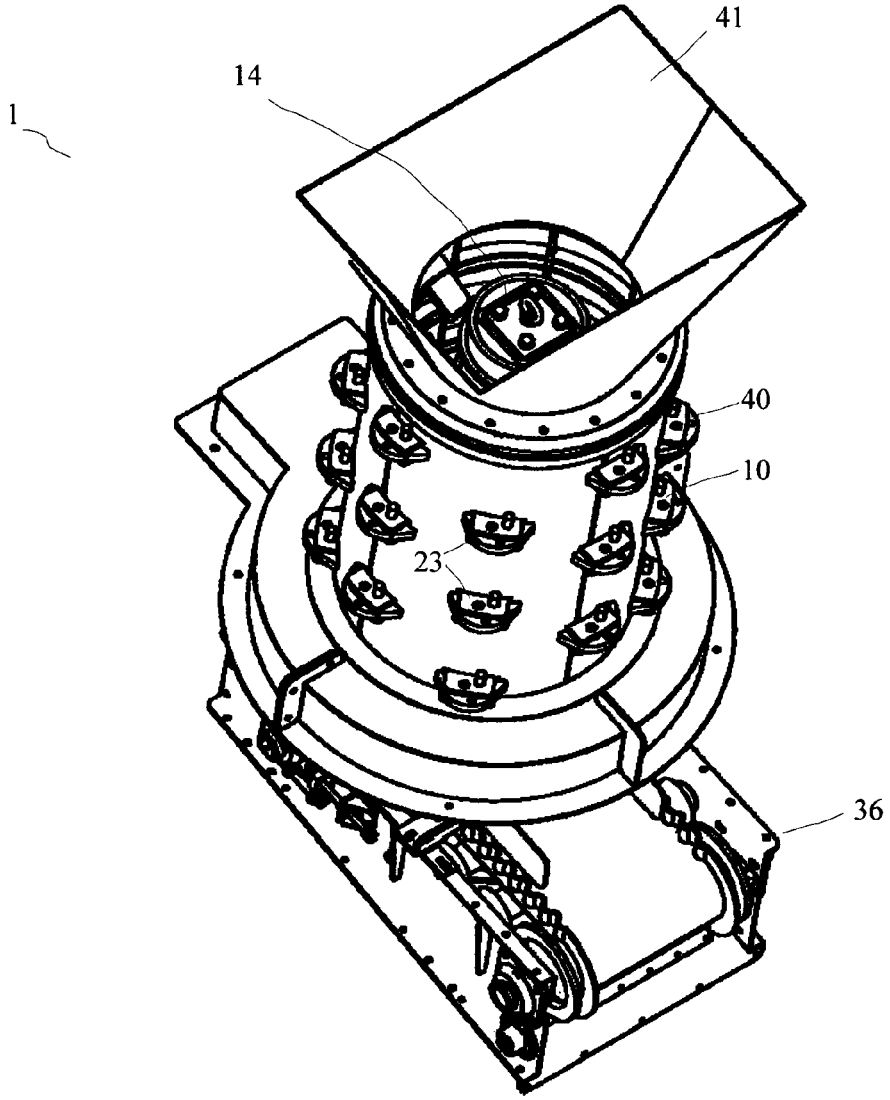

FIG. 10 a perspective illustration of the cleaning device according to the invention.

With reference to the enclosed figures an exemplary embodiment of the system 100 according to the invention will be described below, comprising an inventive cleaning device 1.

FIG. 1 shows a simplistic side view of the system 100 according to the invention, presently comprising a cleaning device 1 and a screening machine 120 positioned downstream.

The system 100 serves for processing materials such as materials comprising granular matter mined from deposits and/or for processing and in particular crushing lumpy foreign matter contained in raw gravel such as clay or the like. The inventive system 100 is also suitable for processing other, similar materials.

The cleaning device 1 schematically shown in FIG. 1 comprises a tubular container 2 and an axle device 3 provided therein. While the axle device 3 is preferably disposed stationary, the tubular container 2 is rotatably supported.

Between the inner wall 4 of the tubular container 2 and the outer wall 11 of the axle device 3 a processing chamber 5 is spanned which when in operation is substantially at all times filled nearly to capacity with material 6 to be processed which is delivered to the cleaning device 1 from above through the top feeding mouth 34.

The material 6 to be processed may have been pretreated or presorted for example in an upstream cleaning device.

The processed material exiting the processing chamber 5 at the lower end 30 is conveyed off via a discharge element 36 such as for example a belt conveyor.

In the illustrated exemplary embodiment the material 6 discharged through the bottom discharge opening 35 is delivered to a screening machine 120 of the processing plant 100. At the screening machine 120 for example a liquid such as water may be added to assist in processing. The material to be processed is preferably separated at the screening machine 120 into at least two fractions which subsequently can be subjected to further treatment steps.

The tubular container 2 of the cleaning device 1 can be driven by an electric motor 32. A drive belt may serve for force transmission from the motor 32 to the tubular container 2. Or else a transmission may be employed consisting of two or more gear wheels or the like.

The rotation of the tubular container 2 is controlled by a control device 31 which may preferably also serve for process monitoring.

For monitoring the degree of filling 37 at least one fill level sensor 33 may be provided which captures a rate of the degree of filling 37 for example optically, electrically, or magnetically. It is also possible to employ a weight sensor which senses for example the weight of the tubular container 2 or the entire cleaning device 1, deriving therefrom a parameter of the degree of filling 37. When the density of the material to be processed is known and/or when empirical data exist, the weight of the cleaning device allows reliable conclusions about the degree of filling 37.

In dependence on the degree of filling and/or empirical values and/or for example the electric power consumption of the motor 32 and/or the current speed of rotation of the tubular container 2, conclusions can be drawn about the operating conditions and correspondingly the speed of rotation of the tubular container 2 can be increased or decreased or for example the quantity of material 6 delivered on top can be increased or reduced to maintain or meet the desired operating point.

Or else the process may be controlled via the quantity and type of the acting working elements 9, 10, or via the diameters of the spacers 15, 16.

Working elements 9 are disposed on the axle device 3. The working elements 9 are referred to as inner or internally disposed working elements 19 because they protrude into the processing chamber 5 from the interior. The quantity, types and orientations of the working elements 9, which may comprise different numbers of engaging dogs 7, is variable and may be chosen as needed.

The tubular container 2 is provided with working elements 10 having engaging dogs 8. The working elements 10 may be referred to as outer or outwardly disposed working elements 20 since their engaging dogs 8 protrude into the processing chamber 5 from the exterior.

As can be better seen in the following figures, the working elements 10 are inserted from the exterior through the wall 24 of the tubular container 2 into the processing chamber 5. The lengths, shapes, and quantity of engaging dogs 8 on the working elements 10 may vary.

This configuration allows to provide a flexible quantity of working elements 10, since working elements 10 can be inserted as needed from the exterior through the insertion openings 23 into the tubular container 2 and thus into the processing chamber 5. This may optionally be done during a short stop in ongoing operation so as to enable adapting and responding to changing conditions of the material 6 to be processed.

FIG. 2 illustrates an enlarged cross section of the cleaning device according to FIG. 1. The axle device 3 is illustrated in the interior of the tubular container 2. The axle device 3 consists of a centered axle 14 which is presently polygonal and preferably square in cross section, onto which spacers 15 or 16 and working elements 9 are successively placed.

Each of the working elements 9 comprises one or more engaging dogs 7. The engaging dogs 7 extend outwardly from the axle 14. The orientation of the engaging dogs 7 may be radial while it may additionally show tangential or vertical components.

A spacer 15 or 16 positioned in-between provides the required distance in the processing direction or the vertical direction 38 between pairs of working elements 9. It is also possible for two or more spacers 15 or 16 to be placed in-line immediately adjacent to one another.

As is clearly shown in FIG. 2, the spacers 15 provided in the upper region are smaller in diameter 17 than the spacers 16 provided in the lower region which show larger outer diameters 18.

In this way a larger working gap 12 is provided in the upper region than in the lower region where there is a clearly smaller working gap 13 between the outer wall 11 of the axle device 3 and the inner wall 4 of the tubular container 2.

It is also possible to provide a smaller gap 13 in a topmost region followed by a larger gap 12 further down which in turn is followed by a smaller gap 13 further down.

Spacers 15, 16 having two or more different outer diameters 17, 18 allow to configure the processing chamber as it is optimal for the material 6 currently processed. The structure may be adapted flexibly since each of the components is pushed onto the axle 14 whose outer cross section is non-round. The spacers 15, 16 in turn provide a round outer cross section so as to reduce wear. Moreover the axle 14 is protected from contamination so as to allow ease of changing the working elements 9.

A water supply 44 may be provided which may be additionally activated as needed for influencing the cleaning process.

FIG. 3 shows another schematic cross section of the cleaning device 1 or the tubular container 2 and the axle device 3. The axle device 3 is presently provided with identical spacers 15, all showing the same outer diameters. The working elements 9 mounted on the axle device 3 are aligned at different angles to the axle 14 to achieve a homogeneous, thorough mixing in the processing chamber 5.

The outer surface of the tubular container 2 is provided with a plurality of insertion openings 23 which are disposed symmetrically distributed over the circumference and at several different heights. The insertion openings 23 allow a flexible quantity of inserted working elements 10. The engaging dogs 8 of the working elements 10 inserted from outside protrude into the interior of the processing chamber 5. Here the working elements 9 and 10 and their engaging dogs 7 and 8 are configured and disposed in the vertical direction 38 so that the operating ranges of the engaging dogs 7 and 8 overlap at least partially. This causes a particularly thorough mixing in the processing chamber. Simple mounting and dismantling is still possible though since for dismantling, the outer working elements 10 can first be removed before the entire axle device 3 or the spacers 15, 16 and the working elements 9 can be removed.

To secure the outer working elements 20 to the tubular container 2 and as a support thereof, stud members 25 are provided which can be inserted in relation to their orientation into one of the two openings 39 of the working elements 10.

In FIG. 3 a wear protection device 26 can be seen additionally. The wear protection device 26 comprises longitudinal stays 28 positioned vertical which are distributed along the inner periphery of the tubular container 2, and horizontal webs 27 disposed at periodic intervals over the height of the tubular container 2.

In this case, double webs 27 are provided between which the insertion openings 23 are provided for inserting the working elements 10. This additionally reinforces the tubular container 2 near the insertion openings 23 to accommodate the loads and stresses. Furthermore the wear protection device 26 also serves to protect the inner wall 4 of the tubular container 2 from wear. Material 6 to be processed will accumulate in operation in the depressions between the webs 27 and the longitudinal stays 28 which thus serves as an autogenous wear protection. Thus the abrading loads and stresses do not act on the inner surface of the inner wall 4 but within the material to be processed. Moreover the webs 27 and stays 28 can support the working elements 10 if they are suitably arranged.

FIG. 4 shows a simplistic top view of a tubular container 2 with a total of four working elements 10 with their engaging dogs 8 inserted through the wall 24 of the tubular container 2. The working elements 10 are arranged offset from one another at angles of 90 degrees.

Two working elements 9 can be seen on the axle device 3 extending from the interior into the processing chamber 5. Both the working elements 9 comprise one engaging dog 7 each having different acting lengths.

In all the configurations different working elements 9, 10 can be employed. FIGS. 5 to 7 show three different variants of working elements 9.

FIG. 5 shows a working element 9 having one single engaging dog 7. FIG. 6 shows a working element 9 having two opposite engaging dogs 7*a* and 7*b*. FIG. 7 shows a working element 9 having three engaging dogs 7*a*, 7*b* and 7*c* provided offset from one another at angles of 120 degrees each.

The inner periphery of the working elements 9 is adapted to the outer periphery of the axle 14 so that the working elements 9 can for one, be non-rotatably disposed on the axle 14 and for another, can be positioned at different angles to one another. FIG. 6 shows exemplarily two different angular positions 21 and 22 to an axle 14 drawn schematically.

FIG. 8 shows two different configurations of a working element 10 with the engaging dogs 8 configured in different lengths. The solid line is a length 43 of the entire working element and the dashed line illustrates another variant of a working element 10 showing a shorter length 42. The working elements 10 are inserted into the processing chamber 5 through a feeding mouth 23 so that the engaging dog 8 protrudes into the processing chamber 5. The openings 39 remain outside of the tubular container 2. A stud member 25 which is inserted into one of the openings 39 allows to secure the working element 10 to the cleaning device 1.

If no working element 10 is needed in any position then a closing head 40 may be inserted instead which does not at all or substantially not enter into the processing chamber 5.

FIG. 10 finally shows a perspective view of the cleaning device 1. The filling hopper 41 can be seen at the top end. One can recognize therein the axle device 3 with the axle 14 that is presently stationary and square in cross section. The inserted working elements 10, which have been inserted into feeding mouths 23, are shown on the outside surface of the tubular container 2. It is also possible to not only insert working elements 10 but also closing heads 40 which when viewed from the outside do not need to differ from working elements 10. It is, however, preferred for the closing heads 40 to differ for example by their color or in structural features so that one recognizes at a glance whether a working element 10 or a closing head 40 is inserted in any position.

On the whole the invention provides a highly compact cleaning device 1 which can operate at degrees of filling 37 of above 75% and in particular above 90% and thus achieves high throughput while requiring little space.

Due to the fact that the working elements 9 and 10 show flexibility in use and replacement, an optimal operating point can be found for virtually any material to be processed. The flexible adjusting of the working gap 12 or 13, which can even be varied within the working device 1, can limit the throughput in a simple way for example by reducing the gap downwardly.

Moreover the inventive cleaning device 1 allows simpler maintenance since in particular the working modules inserted from outside can be exchanged even during short stops without emptying the container 2.

The rotation of the tubular container enables an efficient processing which is energy-saving and requires little space. Due to the rotating outer wall the stressing intensity within the processing chamber 5 is considerably higher than in the prior art. The input energy density is higher so as to allow a more efficient desagglomeration. The shearing gradient acts on the entire rotating surface which is larger than if solely single agitator arms were moved. On the whole an efficient and intense, selective disintegration of the foreign matter adhering to the supplied material is achieved.

| List of reference numerals: | |
|---|---|
| 1 | cleaning device |
| 2 | tubular container |
| 3 | axle device |
| 4 | inner wall |
| 5 | processing chamber |
| 6 | material |
| 7 | engaging dog (inner) |
| 7a | engaging dog (inner) |
| 7b | engaging dog (inner) |
| 7c | engaging dog (inner) |
| 8 | engaging dog (outer) |
| 9 | working element (inner) |
| 10 | working element (outer) |
| 11 | outer wall |
| 12 | working gap |
| 13 | working gap |
| 14 | axle |
| 15 | spacer |
| 16 | spacer |
| 17 | diameter |
| 18 | diameter |
| 19 | inner working element |
| 20 | outer working element |
| 21 | angle |
| 22 | angle |
| 23 | insertion opening |
| 24 | wall |
| 25 | stud member |
| 26 | wear protection |
| 27 | web |
| 28 | longitudinal stay |
| 29 | upper end |
| 30 | lower end |
| 31 | control device |
| 32 | motor |
| 33 | fill level sensor |
| 34 | filling mouth |
| 35 | discharging opening |
| 36 | discharge element |
| 37 | degree of filling |
| 38 | vertical direction |
| 39 | hole (for 25) |
| 40 | insertion lid |
| 41 | filling hopper |
| 42 | length |
| 43 | length |
| 44 | water supply |
| 100 | system |
| 120 | screening machine |

The invention claimed is:

1. Cleaning device for materials to be processed and for crushing lumpy foreign matter contained in raw gravel, with a tubular container disposed upright and an axle device provided therein disposed substantially centered in the tubular container, wherein a processing chamber is provided between the axle device and the inner wall of the tubular container for receiving the material to be processed, characterized in that the tubular container can be driven rotatingly and that engaging dogs are provided as working elements in the processing chamber.

2. The cleaning device according to claim 1 wherein at least one working element is disposed exchangeably on the tubular container.

3. The cleaning device according to claim 2, wherein at least one working element is configured as an outer working element which can be inserted into the processing chamber from outside through the wall of the tubular container.

4. The cleaning device according to claim 3 wherein the outer working element is secured by at least one stud member.

5. The cleaning device according to claim 4 wherein working elements with different engaging dogs are provided where different angles of the engaging dog relative to the longitudinal axis of the engaging dog are provided.

6. The cleaning device according to claim 1 wherein at least one working element is disposed exchangeably on the axle device.

7. The cleaning device according to claim 6 wherein the working elements overlap in the vertical direction.

8. The cleaning device according to claim 1 wherein between the inner wall of the tubular container and an outer wall of the axle device a variable working gap is provided.

9. The cleaning device according to claim 1 wherein the axle device comprises an axle configured non-round surrounded by spacers configured substantially round.

10. The cleaning device according to claim 9 wherein spacers having different diameters are provided for providing different working gaps.

11. The cleaning device according to claim 1 wherein at least one working element is configured as an inner working element which protrudes into the processing chamber from inside.

12. The cleaning device according to claim 11 wherein the inner working element can be non-rotatably clipped onto the axle and/or can be aligned at different angles relative to the axle.

13. The cleaning device according to claim 1 wherein working elements are provided with engaging dogs of different lengths and shapes.

14. The cleaning device according to claim 1 wherein the tubular container at the inner wall has a wear protection device.

15. The cleaning device according to claim 14 wherein the wear protection device is configured as an autogenous wear protection and comprises circumferential webs at least in sections and longitudinal stays extending transverse thereto.

16. The cleaning device according to claim 1 wherein the tubular container is supported in at least one region at the upper and/or lower ends.

17. The cleaning device according to claim 1 wherein a control device is provided with which the rotational speed of the tubular container can be controlled.

18. The cleaning device according to claim 1 wherein at least one fill level sensor is provided.

19. The cleaning device according to claim 1 wherein at least one top filling mouth for delivering material and at least one bottom discharge opening for discharging material are provided, wherein the top filling mouth has a conveyor belt or a filling hopper assigned to it and downstream of the bottom discharge opening at least one discharge element is disposed which is taken from a group of discharge elements including belt conveyors, scraper chain conveyors, rotary vane locks, and vibrating conveyors.

20. The cleaning device according to claim 1 wherein the degree of filling in operation is on average above 0.4.

21. The cleaning device according to claim 1 wherein the axle device is configured stationary.

22. The cleaning device according to claim 1 wherein the axle device is configured rotary and rotating in the opposite sense of the tubular container.

23. System for processing materials comprising at least one cleaning device according to claim 1.

24. The cleaning device according to claim 1 wherein the degree of filling in operation is on average above 0.6.

25. The cleaning device according to claim 1 wherein the degree of filling in operation is on average above 0.7.

26. The cleaning device according to claim 1 wherein the degree of filling in operation is on average above 0.80.

27. Cleaning device for materials to be processed and for crushing lumpy foreign matter contained in raw gravel, with a tubular container disposed upright and an axle device provided therein disposed substantially centered in the tubular container, wherein a processing chamber is provided between the axle device and the inner wall of the tubular container for receiving the material to be processed, characterized in that the tubular container can be driven rotatingly and that engaging dogs are provided as working elements in the processing chamber, wherein at least one working element is configured as an inner working element which protrudes into the processing chamber from inside and wherein the inner working element comprises at least two engaging dogs.

28. Method for processing materials and for crushing lumpy foreign matter contained in raw gravel, with a cleaning device and a tubular container disposed upright therein and an axle device provided therein disposed substantially centered in the tubular container, wherein a processing chamber is provided between the axle device and the inner wall of the tubular container for receiving the material to be processed, characterized in that the tubular container is driven rotatingly and that engaging dogs are provided as working elements in the processing chamber.

* * * * *